US008931198B2

(12) United States Patent
Aalto

(10) Patent No.: US 8,931,198 B2
(45) Date of Patent: Jan. 13, 2015

(54) FIREARM AND FIREARM SYSTEM

(75) Inventor: Juha Aalto, Riihimaki (FI)

(73) Assignee: Sako Oy, Riihimaki (FI)

( * ) Notice: Subject to any disclaimer, the term of this patent is extended or adjusted under 35 U.S.C. 154(b) by 0 days.

(21) Appl. No.: 13/979,954

(22) PCT Filed: Jan. 17, 2011

(86) PCT No.: PCT/FI2011/050032

§ 371 (c)(1),
(2), (4) Date: Jul. 16, 2013

(87) PCT Pub. No.: WO2012/098283

PCT Pub. Date: Jul. 26, 2012

(65) Prior Publication Data

US 2013/0291420 A1 Nov. 7, 2013

(51) Int. Cl.
*F41A 21/48* (2006.01)

(52) U.S. Cl.
CPC ..... *F41A 21/485* (2013.01); *F41A 21/48* (2013.01); *F41A 21/482* (2013.01); *F41A 21/484* (2013.01)
USPC ..... 42/75.02; 89/188

(58) Field of Classification Search
USPC ..... 42/75.02; 89/188
See application file for complete search history.

(56) References Cited

U.S. PATENT DOCUMENTS

| | | | | |
|---|---|---|---|---|
| 3,538,810 | A * | 11/1970 | Maillard | 89/159 |
| 5,987,797 | A | 11/1999 | Dustin | |
| 7,076,904 | B1 | 7/2006 | Rustick | |
| 7,451,564 | B2 | 11/2008 | Wait | |
| 8,479,429 | B2 * | 7/2013 | Barrett et al. | 42/75.02 |
| 2007/0240697 | A1 | 10/2007 | Liao | |

FOREIGN PATENT DOCUMENTS

| | | |
|---|---|---|
| GB | 434 220 A | 8/1935 |

* cited by examiner

*Primary Examiner* — Stephen M Johnson

(57) ABSTRACT

A firearm which is modifiable by the user such that a firearm barrel is arranged replaceable by the user, wherein the firearm comprises a barrel unit, which is detachable by the user and fastenable to a receiver, which barrel unit comprises the barrel and a locking piece, wherein the locking piece has a backward narrowing rear cone, which fits a cone in the receiver and which has a forward narrowing front cone, and which fits a cone in the centering bush, wherein to the centering bush is rotatably connected a clamping bush having an outer thread which fits an inner thread in the receiver, wherein by rotating the clamping bush in the locked direction, the rear end of the locking piece is centerable by means of the rear cone and lockable to the cone in the receiver.

14 Claims, 7 Drawing Sheets

FIREARM AND FIREARM SYSTEM

CROSS REFERENCE TO RELATED APPLICATIONS

This application is the U.S. National Stage of International Application Number PCT/FI2011/050032 filed on Jan. 17, 2011 which was published in English on Jul. 26, 2012 under International Publication Number WO 2012/98283, which application is hereby incorporated by reference.

TECHNICAL FIELD

The invention relates to a firearm which is arranged modifiable by the user such that the barrel of the firearm is arranged replaceable by the user. The invention particularly relates to a so-called firearm with a replaceable barrel which is arranged modifiable by the user such that a firearm calibre or some other property within the same calibre, such as twist rate or type, is arranged changeable by the user by replacing the barrel. The invention also relates to a firearm the barrel of which is a rifle barrel and which is arranged for a high-pressure centrefire cartridge.

The invention further relates to a firearm system which includes at least two barrels of different calibres replaceable by the user with their applicable attachments. At the moment of writing this application, such commercially interesting combinations are e.g. a firearm system arranged for three different calibres, the calibres of which are 308 Win, 300 Win Mag and 338 Lapua Magnum. Then, the same firearm is applicable as for its calibre to cost-effective practice shooting and versatile precision or target shooting and, with larger cartridges, particularly to long-distance precision shooting in the use of either civilians or authorities. Naturally, it is possible to fit in this firearm system by following the same concept almost whichever calibres, such as 222 Rem, 223 Rem, 7.62*39, 30-06, 300 WSM up to the order of .50 BMG and more. The invention is also applicable to firearms employing other types of cartridges, such as low-pressure centre- and rimfire cartridges. Then, one calibre of the firearm system can be e.g. such a calibre employing some other type of cartridge.

BACKGROUND OF THE INVENTION

Of prior art is known, inter alia, U.S. Pat. No. 7,451,564 which describes an interchangeable barrel system for rifles.

Of prior art is also known U.S. Pat. No. 7,076,904 which describes an arrangement related to a detachable gun barrel.

SUMMARY OF THE INVENTION

In the context of this specification, the term 'forward' or 'front direction' refers to the firearm barrel direction i.e. the direction in which a projectile flies when a cartridge in the firearm is fired. Correspondingly, the term 'backward' or 'rear direction' refers to the firearm butt direction which is thus the opposite direction of 'front direction'. A barrel line refers to a line which is at the centre of the barrel, whereby e.g. the centre of rotation of the bullet being shot travels along the barrel line the bullet still being in the barrel. In the context of this specification, a piece sent by the firearm is referred to with the general term of projectile which can be e.g. a bullet, a shell or equivalent.

Equivalently for clarity, in the context of this application, a calibre refers to a cartridge intended for the firearm and firearm properties possibly defined by it, whereby calibres are e.g. 222 Rem, 223 Rem, 7.62*39, 308 Win, 30-06, 300 WSM, 300 Win Mag, 338 Lapua Magnum and so on. In this context, different calibres can also refer to a change arranged within a calibre of the same name or a differing property, such as a change in rifle twist rate or type. An example of such classified here as different calibres is 308 Win having the rifle twist rate of 8 inches per round and 308 Win having the rifle twist rate of 12 inches per round.

An object of the invention is to provide a precision rifle having a replaceable barrel, the barrel of which is freely-floating i.e. the firearm barrel only contacts the other firearm constructions about in the area of the cartridge chamber. An object of the invention is to provide a firearm the calibre of which is changeable by replacing the barrel and which firearm is capable of particularly high precision. An object of the invention is to provide a firearm system which is arranged modifiable by the user such that the barrel of the firearm is arranged replaceable by the user. A further object is that, with the different calibres of the firearm system, the operating properties of the firearm are equivalent to a firearm arranged only for one calibre.

The firearm according to the invention is characterised by the firearm comprising

- a receiver,
- a bolt including locking lugs,
- a barrel unit which is arranged detachable by the user and fastenable in the receiver, which barrel unit comprises a barrel and a locking piece,
- wherein the inside of the barrel is formed as a hollow channel comprising a cartridge chamber for a cartridge to be fired and a hole for sending a projectile,
- wherein the locking piece is formed to comprise an inner shape which engage mating shape of the bolt locking lugs such that the bolt end with its locking lugs is transferrable with a linear motion within the locking piece and lockable by means of a rotational motion such that, by rotating around the longitudinal axis of the bolt, the locking lugs are locked with the respective locking lugs within the locking piece such that the bolt is in a locked position for firing the cartridge,
- wherein the locking piece is formed to comprise an external shape which comprises a backward narrowing rear cone which corresponds a cone in the receiver and which outside shape comprises a forward narrowing front cone which corresponds a cone in a centering bush,
- wherein the centering bush is arranged non-rotatable in relation to the locking piece and both non-rotatable and expanding in the radial direction in relation to the receiver,
- wherein to the centering bush is rotatably connected a clamping bush having an outer thread which corresponds an inner thread in the receiver,
- wherein the receiver, the barrel unit, the centering bush and the clamping bush being in place but in a non-tightened state in relation to each other, by rotating the clamping bush in the locked direction, the rear end of the locking piece is centerable by means of the rear cone and lockable to the cone in the receiver and the locking piece is centerable of its front end by means of the front cone and lockable by means of the centering bush cone and the radially expanding cylinder surface cocentrically in the cylinder surface in the receiver,
- wherein, in the tensioned state, the barrel unit is in contact with the receiver only of the locking piece at the rear cone and at—the front cone.

The firearm system according to the invention is again characterised by the firearm system comprising a firearm according to claim 1, in which a firearm calibre is arranged replaceable by the user by replacing a barrel unit, a bolt or a bolt locking piece and optionally a cartridge magazine. The bolt can have been composed so-calledly of one piece, whereby the bolt is replaced, or it can have been composed of many pieces, whereby only the locking part is arranged replaceable by the user. Replacing the bolt is also optional as far as certain cartridges having a similar head, whereby the same bolt is suitable for several calibres.

A particular advantage of the construction according to the invention is that the barrel is provided freely-floating, whereby the firearm has the prerequisites for being precise. Particularly by means of the presented construction, the firearm is provided to operate repeatably in the same way of its zero, which has conventionally been a possible weak point of rifles with replaceable barrels. Traditionally, it is possible to make the rifles with replaceable barrels to operate accurately, but it has usually required test firing. Now with the firearm according to the present arrangement, the zero is provided at the same point with the important first shot even though the barrel had been replaced in the mean time for smaller calibre e.g. for test firings. The importance of the first shot is particularly high e.g. in the use of authorities whereby, in a situation involving firearms, the whole situation is aimed at resolving with one sole carefully calculated and precise shot. The same principle applies when using the firearm for hunting.

By rotating the clamping bush in the locked direction, the rear end of the locking piece is centerable and lockable by means of the rear cone to the cone in the receiver and the locking piece is of its front end centerable by means of the front cone and lockable by means of the centering bush cone and the radial expanding cylinder surfaces cocentrically to the cylinder surface in the receiver. Due to this property, the construction is relatively insensitive to the tightening torque of the clamping bush which in many known prior-art arrangements seems to change the firearm shot centre quite considerably.

An advantage of the arrangement according to the invention is that parts affecting the firearm accuracy and yet particularly precision and first shot accuracy, particularly the barrel, the locking piece and the bolt, can be positioned extremely repeatably cocentral, whereby the position and direction of the barrel line remain the same despite of detaching and attaching the barrel unit. Considerable heat created in the area of the cartridge chamber when firing cartridges repeatedly is also guided controllably away from the barrel unit via the front cone and the rear cone, whereby dimensional changes caused by thermal expansion does not affect the precision of the firearm by transferring the shot centre.

According to a feature, to the centering bush is rotatably connected a clamping bush having an outer thread which fits an inner thread in the receiver. This way, the construction is provided very compact and robust, whereby external factors cannot affect the critical point for firearm precision i.e. the joint formed by the barrel unit front cone, the centering bush and the inner cylinder surface of the receiver. Due to said inner thread, the clamping bush can be fitted to rotate partially within the receiver for protection. Hence, impacts applied to e.g. the forestock and accessories related to it, such as light amplifiers, lighting devices and equivalents when in use, do not affect the barrel fastening parts but the centering i.e. cocentricity always remains similar. The compact size provided by the property is also important for the accessories to fit well and to keep the total mass of the firearm appropriate, usually as light as possible. By means of the feature, the outside of the receiver front end can also be formed a practical fastening base for said accessories, the receiver front end can be manufactured e.g. as an external cylinder surface very accurate dimensionally, whereby the forestock can further be fastened on top of this external cylinder shape.

According to an embodiment, the receiver includes a locking piece guide which matches the equivalent shape in the locking piece, whereby the barrel unit is installable only in one position in relation to the receiver. Thus, the barrel unit sets by means of the guide always in the same position particularly in relation to the rotation axis around the barrel line. Then, the rear cone and the front cone also set at the same point and position in relation to the receiver.

A further advantage of the construction according to the invention is that the receiver can be manufactured of material for which machineability can be stressed compared to strength properties as selection criteria. By means of the presented construction, forces applied to the construction by pressure caused by shooting the firearm are centred mostly to the unit formed by the locking piece, the bolt and the barrel. The receiver is a relatively large piece having multidimensional shapes compared to the other parts of the firearm, due to which, manufacturing the receiver of high-strength steel would be arduous. Now, it is possible to manufacture the receiver of more easily machineable material, and no post-machining hardening is required or there is no need to provide so high strengths or hardnesses by means of possible tempering as in a construction in which pressure caused by firing affects the receiver directly.

According to an advantageous embodiment, the barrel and the locking piece are formed of different parts and connected together e.g. by means of a thread or a press fit. According to another embodiment, the barrel and the locking piece are formed one-piece i.e. of one piece, whereby the barrel unit is composed of one piece.

BRIEF DESCRIPTION OF THE DRAWINGS

The invention will now be described in more detail with reference to the accompanying figures, in which figures.

DETAILED DESCRIPTION

Figure 1:
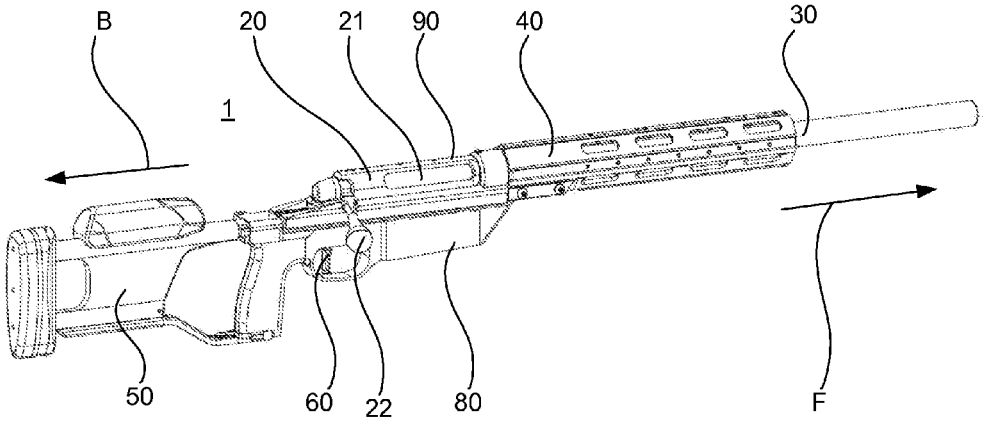
FIG. 1 shows a general view of a firearm.

FIG. 1 shows a general view of a firearm 1. The figure depicts the main features of the firearm observable from outside. A receiver 20 operates here as the firearm body around which the firearm 1 can be considered to construct. Within the receiver, there is a bolt 21 to operate which is arranged a bolt handle 22. By means of the bolt handle 22, the bolt is transferrable with a linear forward F motion to its front position and lockable by means of a rotational motion such that, by rotating around the longitudinal axis of the bolt 21, the bolt 21 is locked in its locked position for firing a cartridge. During the linear motion, the bolt 21 can take along one cartridge from a cartridge magazine 80. The firearm also depicts a forestock 40 for the user's front hand and for attaching possible accessories. In the receiver is also fitted a sight rail 90 for fastening a sight (not shown in the figures). The firearm includes a rear stock 50 which is arranged for supporting the firearm backward B against the user's shoulder. The firearm 1 is triggerable by means of a trigger unit 60.

Figure 2:
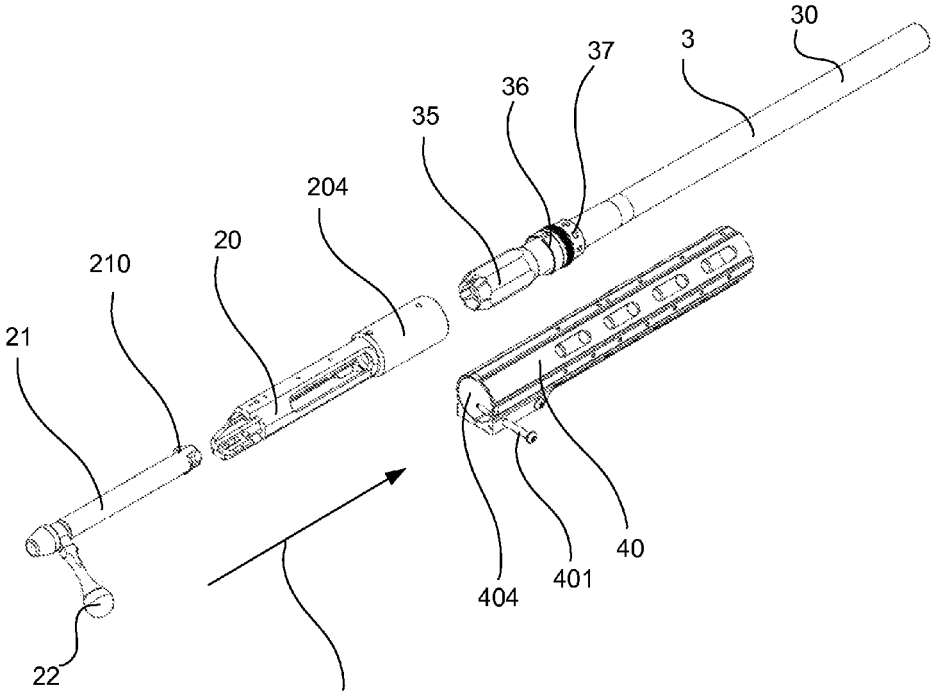
FIG. 2 shows a general view according to an embodiment of firearm main parts related to the invention.

FIG. 2 shows an explosion view of the construction of the firearm 1 in more detail. FIG. 2 depicts the bolt 21 which includes bolt locking lugs 210 (here shown an embodiment which has three locking lugs) and the bolt handle 22. The bolt is arranged transferrable within the receiver 20 by means of a forward F directing motion. A barrel unit 3 is arranged detachable by the user and fastenable to the receiver 20, which barrel unit 3 comprises a barrel 30 and a locking piece 35. FIG. 2 also shows in connection with the barrel a centering bush 36 and a clamping bush 37 which both are slidable with clearance from the front end of the barrel 30 along the barrel to a position shown in the figure. When the barrel unit 3 is tightened in its position by means of the centering bush 36 and the clamping bush 37, the forestock 40 is settable in place, whereby a cylinder surface 404 within the forestock fits an external cylinder surface 204 of the receiver 20. The forestock can be tightened in place by means of fasteners 401.

Figure 3:
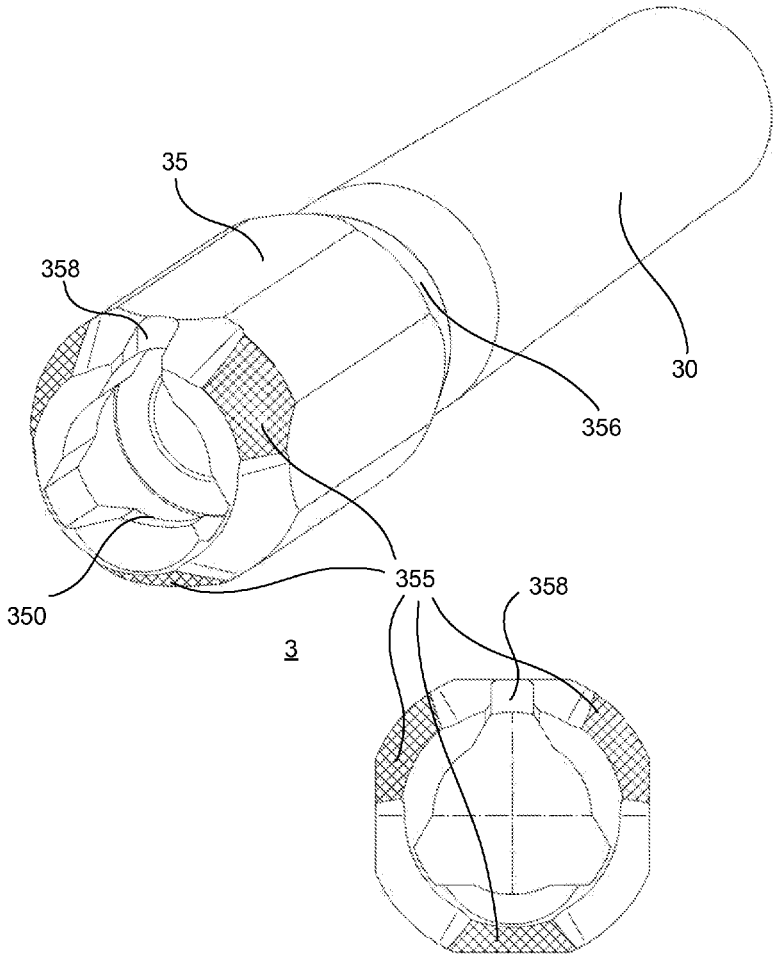
FIG. 3 shows a barrel unit according to an embodiment.

FIG. 3 shows in detail a barrel unit 3 according to an embodiment from two different directions (approximately isometric projection and directly from the back). The barrel unit 3 thus comprises the barrel 30 and the locking piece 35. The locking piece 35 is formed to comprise an inner shape which engage mating shape of the locking lugs 210 of the bolt 21 such that the bolt 21 end with its locking lugs 210 is transferrable with a linear motion within the locking piece 35 and lockable by means of a rotational motion such that, by rotating around the longitudinal axis of the bolt 21, the locking lugs 210 are locked with respective locking lugs 350 within the locking piece 35 such that the bolt 21 is in a locked position for firing the cartridge. The bolt is not shown in FIG. 3.

FIG. 3 shows an embodiment on how the locking piece 35 can be formed to comprise also an external shape which comprises a backward narrowing rear cone 355 which corresponds a cone 205 in the receiver and which outside shape comprises a forward narrowing front cone 356 which corresponds a cone 366 in the centering bush 36. To the rear cone 355 of the locking piece 35 can have been formed one or more, such as three, bearing surfaces. The three bearing surfaces (shown in FIG. 3 as checkered) is advantageous as far as that the cone surface is then particularly non-sensitive to impurities and, by means of the three bearing surfaces, the rear cone of the locking piece fits very stably on the cone surface of the receiver 20. In an equivalent way, to the front cone 356 of the locking piece can have been formed one or more, such as three, bearing surfaces.

The locking piece 35 includes a guide 358 which matches a respective locking piece guide 208 in the receiver 20, whereby the barrel unit 3 is installable only in one position in relation to the receiver 20.

According to an advantageous embodiment, the barrel 30 and the locking piece 35 are formed of different parts and connected together e.g. by means of a thread or a press fit. According to another embodiment, the barrel 30 and the locking piece 35 are formed one-piece i.e. of one piece, whereby the barrel unit 3 is formed of one piece.

Figure 4A:
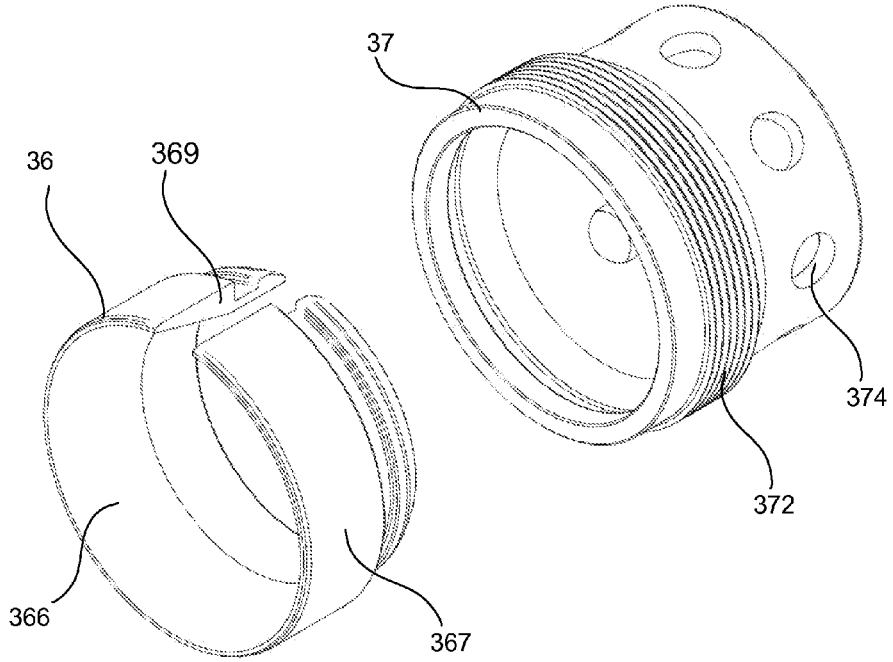
FIGS. 4*a*, 4*b* and 4*c* show a centering bush and a clamping bush according to an embodiment.
Figure 4B:
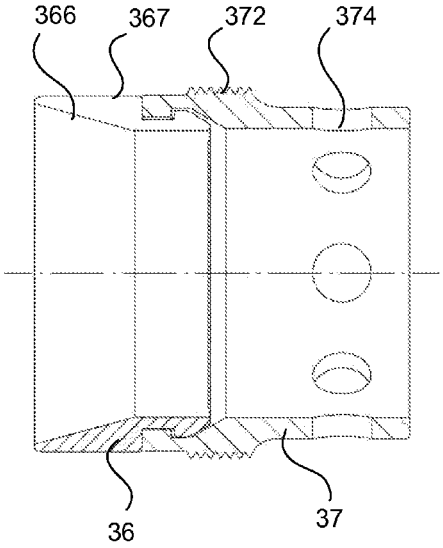

FIGS. 4*a* and 4*b* show a centering bush and a clamping bush according to an embodiment. The centering bush 36 is arranged non-rotatable in relation to the locking piece 35 and both non-rotatable and expanding in the radial direction in relation to the receiver 20. The non-rotatability can be implemented e.g. by means of a groove 369 and a matching centering bush guide 209, whereby the centering bush cannot rotate in relation to the locking piece when the cone surface 366 of the centering bush slides along the equivalent front cone 356 of the locking piece. Simultaneously, a centering bush cylinder surface 367 expands in the radial direction and is locked in a receiver cylinder surface 207. To the centering bush 36 is rotatably connected the clamping bush 37 having an outer thread 372 which corresponds an inner thread 202 in the receiver. FIG. 4*a* shows an embodiment where the circle of the centering bush 36 is cut at one point, whereby the cutting point is formable into a groove 369 of the length of the centering bush and which groove 369 matches the guide 209 in the receiver 20. FIG. 4*a* also shows an embodiment of the clamping bush 37 which includes the outer thread 372 and a tool stopper 374.

FIG. 4*b* shows a cross section of a centering bush 36 and a clamping bush 37 according to an embodiment rotatably connected together. In FIG. 4*b*, a rotation axis is designated with dot-and-dash lines. This rotation axis also corresponds the barrel line.

Figure 4C:
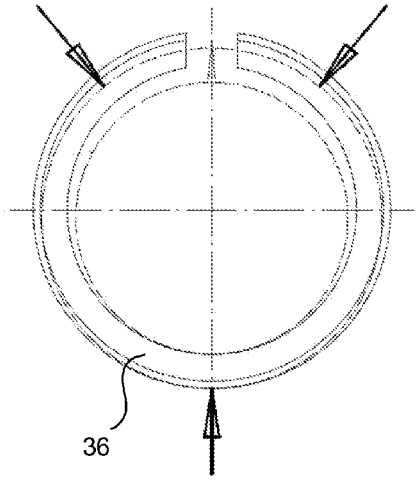

FIG. 4*c* shows an embodiment on how the centering bush 36 is installable fast in the clamping bush 37. By means of the groove 369, the centering bush is pressable somewhat smaller, whereby the grooves/notches seen in Fig. b are able to pass each other and the centering bush is locked in the clamping bush rotatably. In FIG. 4*c*, press points are shown with arrows.

Figure 5:
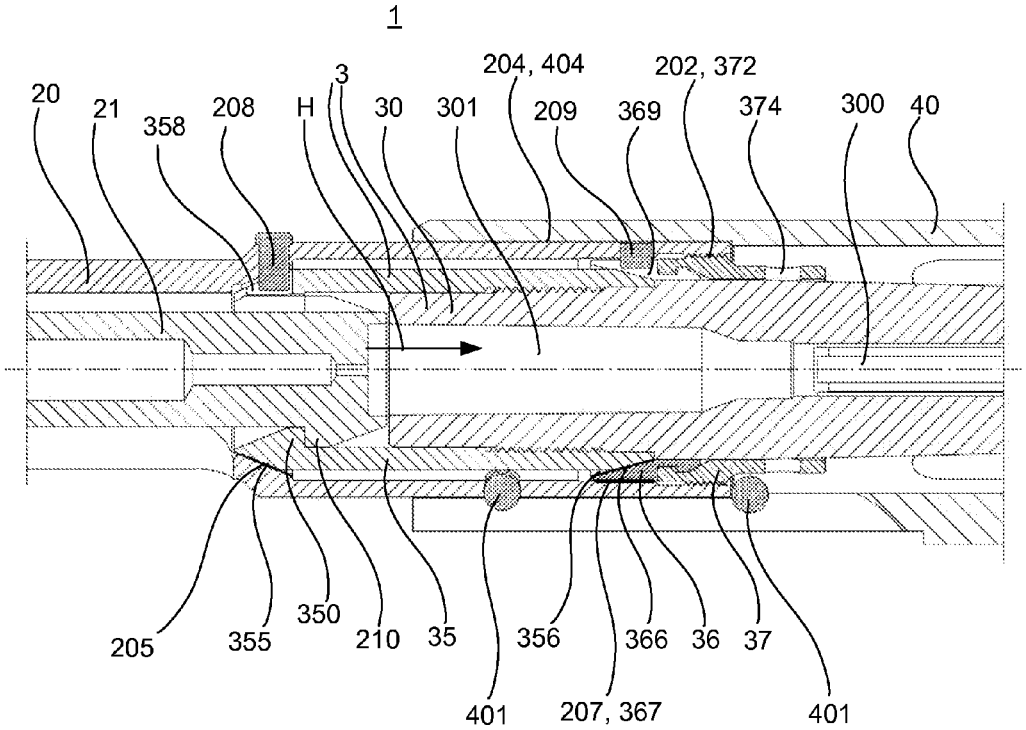
FIG. 5 shows a cross section of a firearm construction according to an embodiment.

FIG. 5 shows a cross section of a firearm 1 which is arranged modifiable by the user such that a firearm barrel 30 is arranged replaceable by the user, whereby the firearm comprises

- a receiver 20,
- a bolt 21 including locking lugs 210,
- a barrel unit 3 which is arranged detachable by the user and fastenable to the receiver 20, which barrel unit 3 comprises a barrel 30 and a locking piece 35,
- whereby the inside of the barrel 30 is formed as a hollow channel comprising a cartridge chamber 301 for a cartridge to be fired and a hole 300 for sending a projectile,
- whereby the locking piece 35 is formed to comprise an inner shape which engage mating shape of the locking lugs 210 of the bolt 21 such that the bolt 21 end with its locking lugs 210 is transferrable with a linear motion within the locking piece 35 and lockable by means of a rotational motion such that, by rotating around the longitudinal axis of the bolt 21, the locking lugs 210 are locked with respective locking lugs 350 within the locking piece 35 such that the bolt 21 is in a locked position for firing the cartridge,
- whereby the locking piece 35 is formed to comprise an external shape which comprises a backward narrowing rear cone 355 which corresponds a cone 205 in the receiver and which outside shape comprises a forward narrowing front cone 356 which corresponds a cone 366 in the centering bush 36,
- whereby the centering bush 36 is arranged non-rotatable in relation to the locking piece 35 and both non-rotatable and expanding in the radial direction in relation to the receiver 20,
- whereby to the centering bush 36 is rotatably connected a clamping bush 37 having an outer thread 372 which corresponds an inner thread 202 in the receiver 20,
- whereby the receiver 20, the barrel unit 3, the centering bush 36 and the clamping bush 37 being in place but in a non-tightened state in relation to each other, by rotating the clamping bush 37 in the locked direction, the rear end of the locking piece 35 is centerable by means of the rear cone 355 and lockable to the cone 205 in the receiver 20 and the locking piece 35 is centerable of its front end by means of the front cone 356 and lockable by means of the cone 366 of the centering bush 36 and a radially expanding cylinder surface 367 cocentrically in a cylinder surface 207 in the receiver, whereby, in the tensioned state, the barrel unit 3 is in contact with the receiver 20 only of the locking piece 35 at the rear cone 355 and at the front cone 356.

FIG. 5 also shows how a forestock 40 can be fastened by means of fasteners 401, such as screws, to the receiver 20 such that the forestock cylinder surface 404 presses around the external cylinder surface 204 of the receiver. Similarly, it is shown in FIG. 5 how a head space H is arranged to be formed based on the mutual position of the locking piece 35, the bolt 21 and the barrel 30, whereby the head space H of the firearm 1 remains set despite calibre changes performed by the user.

Figure 6A:
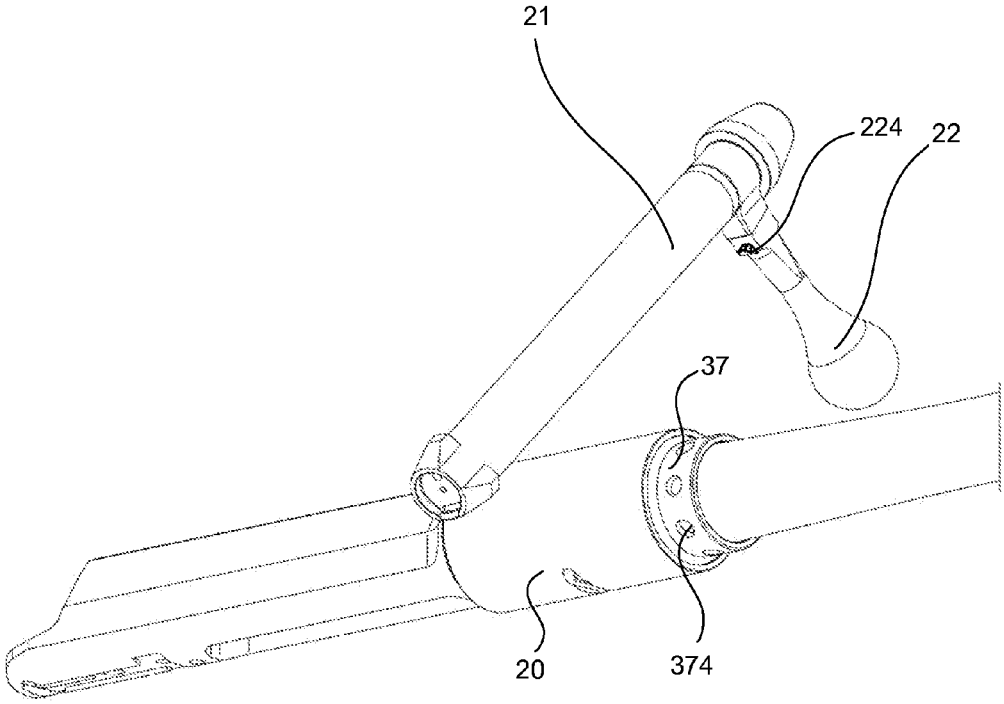
FIGS. 6*a* and 6*b* show an arrangement for replacing a firearm barrel according to an embodiment.
Figure 6B:
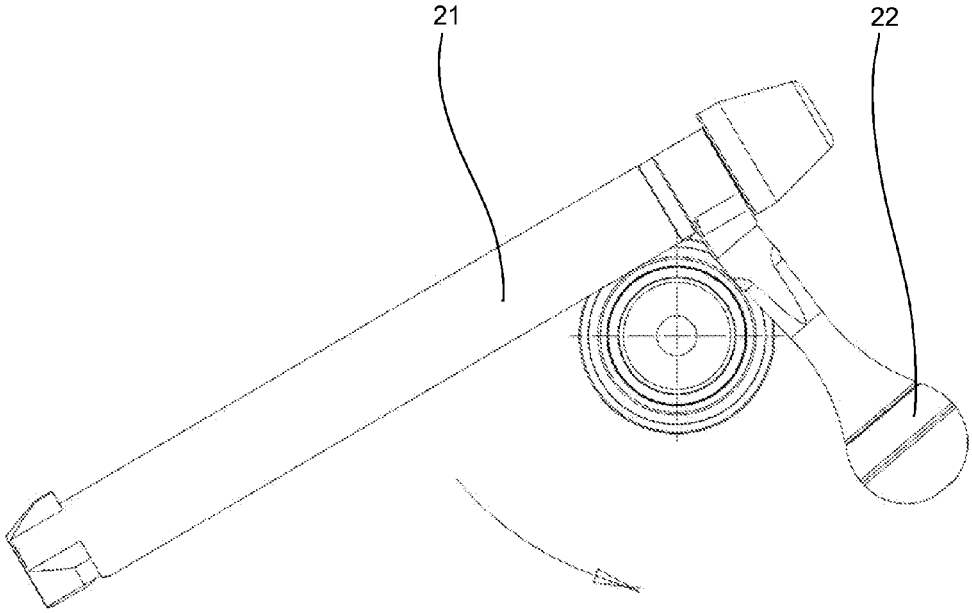

FIGS. 6*a* and 6*b* show an embodiment of the firearm system in which into connection with the bolt handle 22 is fitted a tool 224 which fits a tool stopper 374 on the circle of the clamping bush 37, whereby the clamping bush 37 is arranged openable by the user or tightenable using the bolt 21 as a tool.

Figure 7A:
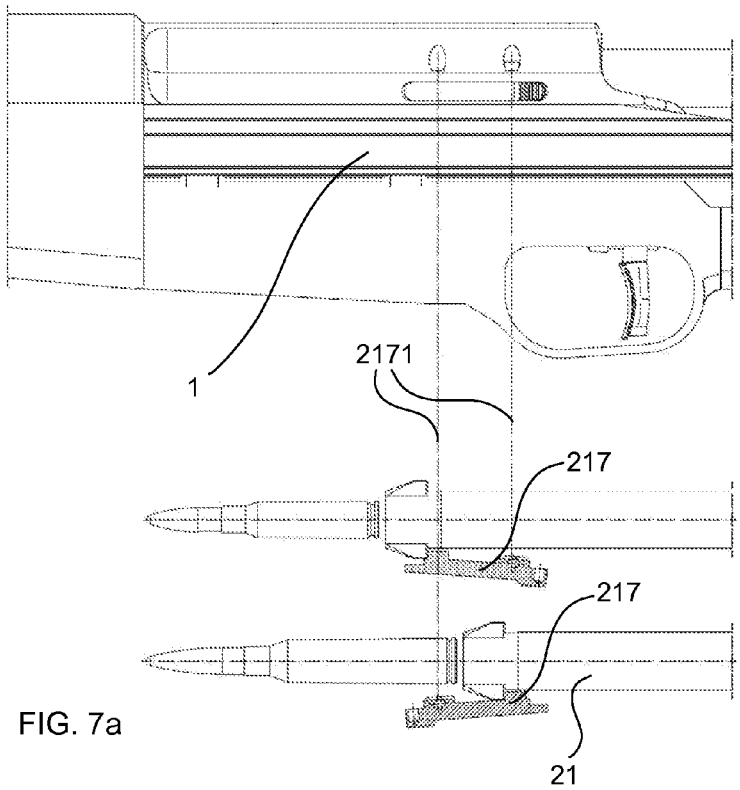
FIGS. 7*a* and 7*b* show a firearm system according to an embodiment, which employs two different cartridge lengths.
Figure 7B:
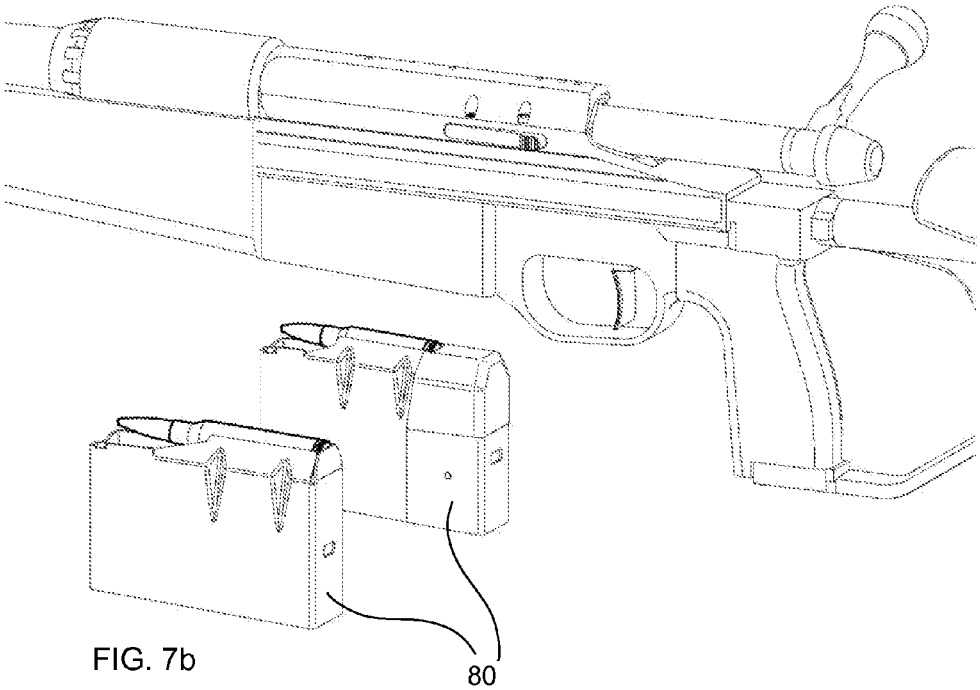

FIGS. 7*a* and 7*b* show a firearm, which belongs to a firearm system, which firearm system comprises at least two calibres, in which the maximum cartridge overall length between said two calibres differ moderately from each other, advantageously over 20 mm, whereby the action length of the bolt is arranged modifiable by the user by turning a bolt release lever 217. The length of the bolt motion is optimally as close as possible to such a length that an empty case exits the cartridge chamber and an unfired cartridge is fetched from the cartridge magazine and pushed to the cartridge chamber. Then, the bolt end has to go so far backwards that it passes the cartridge head in the cartridge magazine. When comparing e.g. cartridges in the calibres of 308 Win and 338 Lapua Magnum, it is possible to see that, checked from the table, the largest standard cartridge overall length of 308 Win is about 71.12 mm (2.8") and the largest standard cartridge overall length of 338 Lapua Magnum is about 93.50 mm (3.681"). Then, the length of bolt action arranged for 308 Win can be referred to as short action and, correspondingly, the length of bolt action arranged for 338 Lapua Magnum can be referred to as long action. A long bolt path is not useful when using a short cartridge, most often on the contrary, as it can cause the user problems if the user's charge motion is not correct by routine.

In an embodiment of the firearm system according to the invention, this possible error situation is eliminated by means of the turnable bolt release lever, whereby the bolt action length is arranged modifiable by the user by turning the bolt release lever 217. It is seen in FIG. 7 that the bolt release lever is arranged two-axis such that two alternative positions are arranged for the release lever, a short action position and a long action position. In FIG. 7*a*, these said two axes 2171 are designated by dot-and-dash lines. The backward motion of the bolt stops to the stopper in the bolt release lever 217, whereby the user sees that the bolt motion has now been performed and the forward pushing charging motion can be started. FIG. 7*b* shows how these different calibres can be loaded with different magazines 80. Advantageously, a limiter is used which contacts the cartridge head i.e. rear end.

Figure 8:
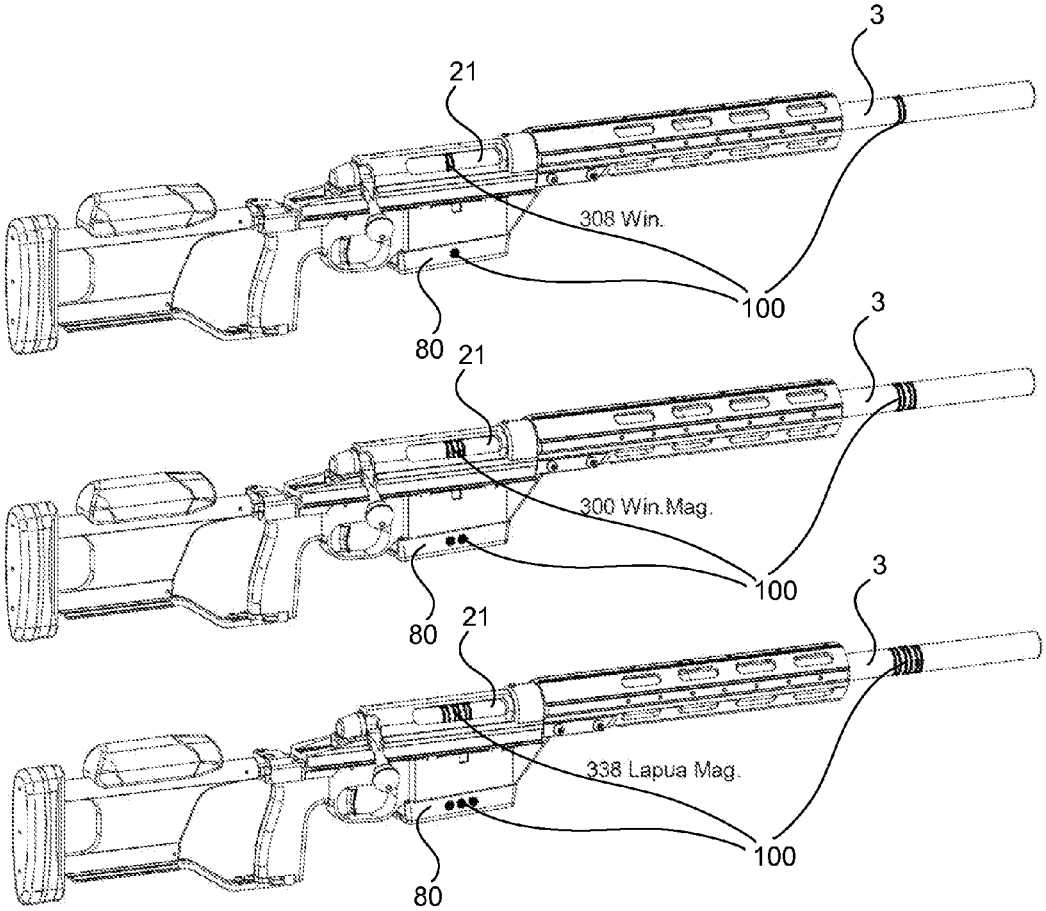
FIG. 8 shows a firearm system according to an embodiment, in which replaceable parts are identified.

FIG. 8 shows a firearm system according to a yet other embodiment, in which the firearm system comprises at least two calibres, whereby the barrel unit 3, the bolt 21 and the cartridge magazine 80 corresponding the same calibre of the firearm 1 and related to each other are marked with an identity code 100 detectable by sense of touch and sense of sight. The identity code advantageously comprises grooves or embossed dots, whereby replacing the barrel is also performable solely by means of the sense of touch.

As evident to those skilled in the art, the invention and its embodiments are not limited to the above-described embodiment examples. Expressions representing the existence of characteristics, such as "the firearm comprises a receiver", are unlimited such that the description of characteristics does not exclude or prerequisite the existence of such other characteristics which are not presented in the independent or dependent claims.

Reference Numbers Used in the Figures

1 firearm
20 receiver
202 receiver internal thread
204 receiver external cylinder surface
205 receiver cone
207 receiver cylinder surface
208 locking piece guide
209 centering bush guide
21 bolt
210 locking lugs
22 bolt handle
3 barrel unit
30 barrel
300 barrel bore
301 cartridge chamber
35 locking piece
350 locking lugs of locking piece
355 rear cone
356 front cone
358 guide
36 centering bush
366 centering bush cone
367 centering bush cylinder surface
369 centering bush notch
37 clamping bush
372 clamping bush external thread
374 clamping bush tool stopper
40 forestock
401 forestock fastener
404 forestock cylinder surface
50 rear stock
60 trigger unit
80 cartridge magazine
100 identity code
H head space
F front direction
B rear direction

The invention claimed is:

1. A firearm comprising:

a receiver, a bolt comprising bolt locking lugs, a barrel unit configured to be detached and fastened to the receiver by the user, comprising:

a barrel having a hollow channel comprising a cartridge chamber for receipt of a cartridge and a bore for passage of a projectile when a cartridge is fired, and a locking piece comprising:

locking lugs dimensioned to engage with the bolt locking lugs after the bolt traverses longitudinally relative to the locking piece and is rotated relative to the locking piece, a rear end section configured to be received by the receiver, and a front end section;

a centering bush configured to receive the front end section of, and be non-rotational relative to, the locking piece, and to be non-rotational and expand in a radial direction relative to the receiver; and a clamping bush connected to, and rotatable about, the centering bush, and having an threaded portion configured to receive a corresponding threaded portion of the receiver;

wherein the receiver, the barrel unit, the centering bush and the clamping bush are configured to be transferred from a released state to a tightened state by rotating the clamping bush into a locked position with respect to the receiver, centering the rear end section of the locking piece and securing the locking piece to the receiver, centering the front end section of the locking piece and securing the locking piece to the centering bush, and locking a radially expanding cylinder surface of the centering bush concentrically in a cylinder surface in the receiver, and wherein, in the tightened state, the barrel is in contact with only the locking piece.

2. The firearm according to claim 1, wherein the rear end section of the locking piece comprises one or more bearing surfaces.

3. The firearm according to claim 1, wherein the front end section of the locking piece comprises one or more bearing surfaces.

4. The firearm according to claim 1, wherein the locking piece and the barrel are formed as a single unit such that the barrel unit is formed as one piece.

5. The firearm according to claim 1, wherein the receiver includes a locking piece guide which matches the shape of a respective guide in the locking piece, and wherein the barrel unit is configured to be installed in only one position in relation to the receiver.

6. The firearm according to claim 1, wherein the centering bush comprises a groove along the length of the centering bush configured to correspond to a centering bush guide in the receiver.

7. The firearm according to claim 1, wherein the barrel is in contact with the firearm only via the locking piece.

8. The firearm according to claim 1, wherein in the tightened state, the centering bush is in contact with the receiver, the locking piece and the clamping bush.

9. The firearm according to claim 1, wherein the receiver is arranged to operate as a body of the firearm such that a firearm rear stock, a forestock, and a trigger unit are fastenable to the receiver.

10. A firearm system comprising:

the firearm according to claim 1, and a firearm calibre configured to be changeable by the user by replacing the barrel unit, the bolt or the bolt locking lugs and optionally a cartridge magazine.

11. The firearm system according to claim 10, comprising a head space formed based on the positions of the locking piece, the bolt and the barrel, and configured to remain in a set position if calibre changes are performed by the user.

12. The firearm system according to claim 10, further comprising a handle for the bolt comprising a tool configured to fit a tool stopper on the clamping bush, wherein the clamping bush is configured to be opened or tightened by the user using the bolt and bolt handle.

13. The firearm system according to claim 10, further comprising at least two calibres with a maximum cartridge length between said two calibres greater than 20 mm, and wherein the action length of the bolt is configured to be modified by the user by turning a bolt release lever.

14. The firearm system according to claim 10, further comprising at least two calibres, wherein the barrel unit, the bolt and the cartridge magazine correspond to the same calibre and are marked with an identity code detectable by touch and sight.

* * * * *